US006016631A

United States Patent [19]

Lowrie, III

[11] Patent Number: 6,016,631

[45] Date of Patent: Jan. 25, 2000

[54] RAIN GUTTER DEVICES

[76] Inventor: Edmund G. Lowrie, III, 29W513 Forest View Ct., Warrenville, Ill. 60555

[21] Appl. No.: 08/989,375

[22] Filed: Dec. 12, 1997

[51] Int. Cl.[7] ..... E04D 13/04

[52] U.S. Cl. ..... 52/12

[58] Field of Search ..... 52/11, 12

[56] References Cited

U.S. PATENT DOCUMENTS

| | | | |
|---|---|---|---|
| 2,583,422 | 1/1952 | Haddon | 52/12 X |
| 4,307,976 | 12/1981 | Butler . | |
| 4,333,208 | 6/1982 | Fuller . | |
| 4,404,775 | 9/1983 | Demartini . | |
| 4,745,710 | 5/1988 | Davis . | |
| 4,750,300 | 6/1988 | Winger, Jr. . | |
| 4,876,827 | 10/1989 | Williams | 52/12 |
| 4,907,381 | 3/1990 | Ealer . | |
| 4,937,986 | 7/1990 | Way, Sr. et al. | 52/12 |
| 4,959,932 | 10/1990 | Pfeifer | 52/12 |
| 4,964,247 | 10/1990 | Spica . | |
| 4,965,969 | 10/1990 | Antenen | 52/12 |
| 5,257,482 | 11/1993 | Sichel . | |
| 5,271,192 | 12/1993 | Nothum, Sr. . | |
| 5,321,920 | 6/1994 | Sichel . | |
| 5,398,464 | 3/1995 | Jacobs . | |
| 5,471,798 | 12/1995 | Kuhns | 52/12 |
| 5,522,183 | 6/1996 | Allen . | |
| 5,555,680 | 9/1996 | Sweers . | |
| 5,557,891 | 9/1996 | Albracht . | |
| 5,592,783 | 1/1997 | Jones . | |
| 5,611,175 | 3/1997 | Sweers . | |
| 5,619,825 | 4/1997 | Leroney . | |
| 5,623,787 | 4/1997 | Ali . | |
| 5,632,299 | 5/1997 | Weinhold . | |
| 5,640,809 | 6/1997 | Iannelli | 52/12 |
| 5,813,173 | 9/1998 | Way, Sr. | 52/12 |

OTHER PUBLICATIONS

Brochure for "The Waterfall Gutter Guard System".

Brochure for "Quik–Snap Gutter Screens," Omni Products, 1540 W. Fullerton Avenue, Addison, IL 60101.

Brochure for "Rain Diverter," Omni Products, 1540 W. Fullerton Avenue, Addison, IL 60101.

Brochure for "Leafproof" gutters and downspouts, Eran Industries, Inc.

"Leafproof product comparison sheet".

*Primary Examiner*—Christopher T. Kent

*Attorney, Agent, or Firm*—Wolf, Greenfield & Sacks, P.C.

[57] ABSTRACT

Gutter devices for keeping debris out of a gutter are disclosed. The gutter devices may include more than one mode of permitting water to enter into the gutter. A first mode is a plurality of holes disposed in the gutter protection device. A second mode is a bend at a lower end of the gutter protection device, permitting water to flow around the bend and into the gutter. The gutter protection device may further include a bend in its upper portion, corresponding to the pitch of a roof. The openings in the gutter device may be substantially vertical or formed by creating a depression in the surface of the gutter protection device.

26 Claims, 4 Drawing Sheets

RAIN GUTTER DEVICES

FIELD OF THE INVENTION

This invention relates to rain gutters, and more particularly to a device permitting water to flow into the gutter while preventing debris from entering the gutter.

SUMMARY OF THE RELATED ART

Most residences and many commercial buildings have gutters at the edge of the roof to collect water and direct the water away from the building through a downspout. These gutters may be formed of aluminum, copper, wood, steel or other materials. A problem often arises, however, when debris such as tree leaves falls into the gutter. The debris causes the downspouts to clog, preventing the gutter system from performing as intended. While the problem is easily remedied by cleaning the gutters, the added maintenance can be frustrating.

A number of devices have been proposed to reduce or eliminate the need to clean gutters. These devices have fallen into two separate classes—screens and deflectors.

Gutter screens typically involve a fine or coarse screen over the top of the gutter. Water flows into the gutter through the screen, while the screen prevents debris from entering the gutter.

Deflector devices do not include any internal screens or other openings through which water can pass. Instead, the deflector has a curved edge. Water and debris passes over the top of the surface of the deflector. The surface tension of the water forces the water to follow the curved edge and flow back into a gutter. Debris, however, flows off of the curved edge and over the edge of the gutter. Such deflector devices are described in U.S. Pat. No. 4,404,775. In many cases, a bottom edge of the deflector rests on the lip of the gutter. The bottom edge of the deflector is held to the main body (and the curved edge) by longitudinal segments. Water flows over the curved edge of the deflector and into the gutter, falling between the longitudinal segments. The bottom edge is secured to the gutter using a clip, attached underneath the bottom edge, which hooks into the lip of the gutter. In some commercial embodiments, the water passes over more than one curved edge. Each curved edge functions as above, hopefully having water fall into the gutter (between the longitudinal segments attaching the curved edge to the lower curved edge or lower part of the deflector, which rests on the lip of the gutter) by following one of the curved edges.

SUMMARY OF THE INVENTION

According to one embodiment of the present invention, a gutter protection device is disclosed that has an upper portion, a middle portion that includes a plurality of openings, and a lower portion that includes a bend, whereby water can flow into the gutter through the openings or over the bend, when the gutter protection device has been installed. The upper portion may include a second bend selected according to the pitch of the roof, and the upper, middle and lower portions may be sized so that the upper portion may be inserted under the lowest row of shingles on the roof.

According to another embodiment of the present invention, a gutter protection device is disclosed that includes a surface and a plurality of openings in the surface, each opening being located proximate to a respective depressed portion of the surface.

According to another embodiment of the present invention, a gutter protection device is disclosed that includes a substantially planar surface and a plurality of substantially vertical openings in the surface.

According to another embodiment of the present invention, a gutter protection device is disclosed that has an upper portion having a first bend, a middle portion, and a lower portion that includes a second bend, whereby water can flow over the second bend into the gutter. According to this embodiment, the upper portion, middle portion and lower portion are sized so that a part of the upper portion may be inserted under a lowest row of shingles for the roof.

According to another embodiment of the present invention, a method of keeping debris from a gutter is disclosed. According to this embodiment, a gutter protection device is installed. Water is permitted to enter the gutter, while debris is kept from the gutter, through a first mode of filtering. Water is also permitted to enter, while debris is kept from, the gutter through a second mode of filtering. The first mode of filtering may comprise a step of passing water over a plurality of openings in the gutter protection device. The second mode of filtering may comprise a step of passing water over an arcuate bend in the gutter protection device, whereby water follows the bend while debris falls off the bend.

DETAILED DESCRIPTION

In most cases, screens have proven inadequate for keeping gutters free of debris. Generally, the screens permit too much debris to flow through the screen openings into the gutter. In addition, screens sometimes collect debris, and water flows over the debris and, therefore, over the edge of the gutter. Accordingly, gutter screens have reduced, but not eliminated, the need for cleaning of gutters.

Debris deflectors have also proved inadequate. By relying entirely on the surface tension of the water, the gutter deflectors are not sufficiently efficient. Accordingly, for particularly heavy rains, the water flows over the edge of the deflector and over the lip of the gutter—the water never enters the gutter and the gutter fails. In addition, the deflector devices currently available cannot be used on steep roofs. Even if the device were installed on a steep roof, water would pass over the device so quickly that it would, again, flow over the edge of the lip of the gutter and straight down to the ground.

Accordingly, the art suffers from a number of deficiencies. Ideally, a gutter device should be provided that (1) efficiently directs water from the roof into the gutter; (2) prevents debris from entering the gutter; (3) is inexpensive and easy to install; (4) can be manufactured by a simple method, using materials readily available; and (5) can be removed from the gutters easily, in the event that something is in the gutter that needs to be removed. Certain embodiments of the present invention achieve some or all of these goals.

Figure 1:
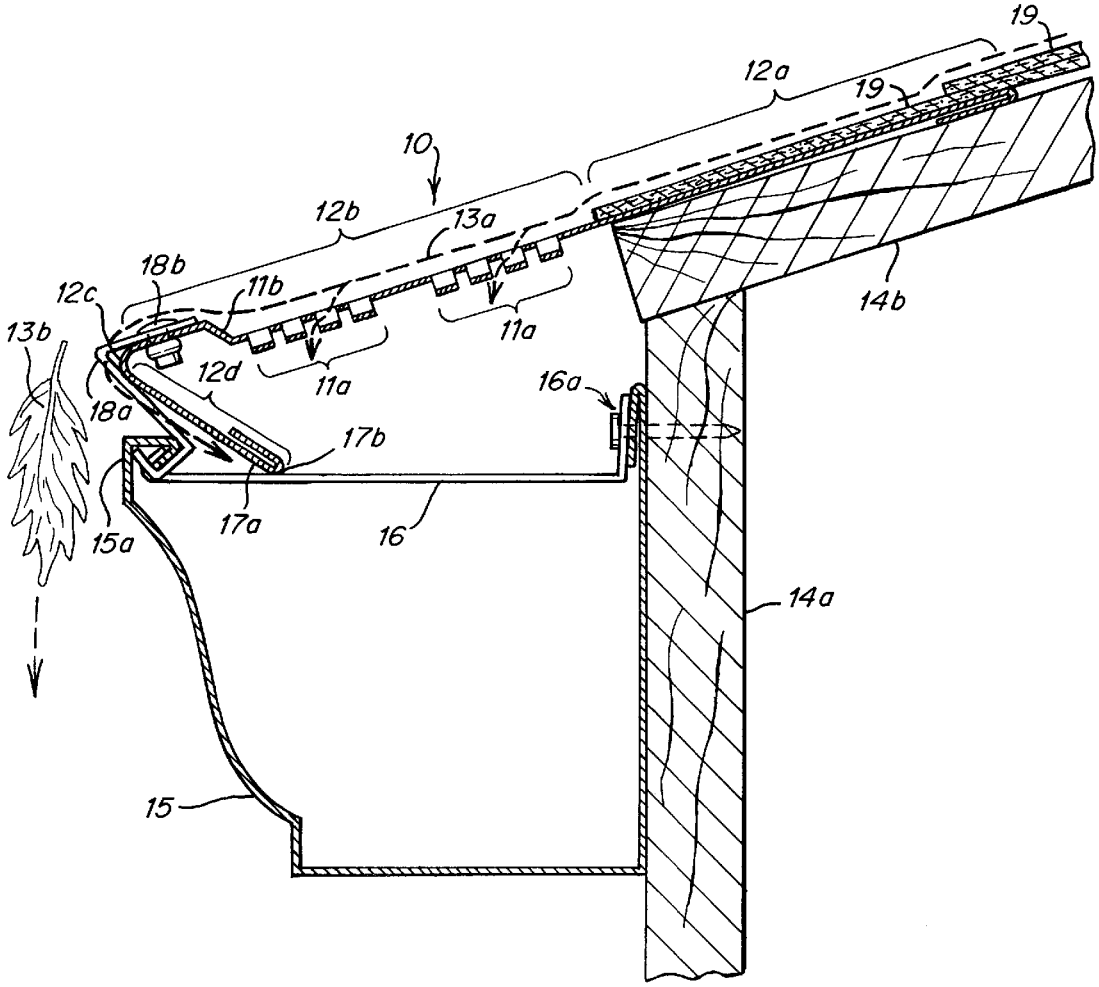
FIG. 1 illustrates one embodiment of a gutter device according to the present invention, as installed.

FIG. 1 illustrates one embodiment of a gutter protector 10, according to the present invention. In the embodiment of FIG. 1, the gutter protector 10 is installed on a gutter 15. The gutter 15 is attached to a fascia board 14*a*. To hold a front lip 15*a* of the gutter 15 up, a bar hanger 16 is installed. The bar hanger is shaped to wrap into the front lip 15*a* of the gutter 15, and is nailed to the fascia board at 16*a*. The gutter 15 is located at a level below the roofing board 14*b* and shingles 19.

The gutter protector 10 includes an upper portion 12*a* that is tucked underneath the shingles 19, and on top of the roof board 14*b*. If the gutter system includes flashing (not shown), the gutter protector 10 may be installed on top of the flashing as well. Thus, the upper portion 12*a* of the gutter protector is designed to extend up under the roof a predetermined amount, such as 3 inches. The amount may be selected to assure that the gutter protector remains secure under the shingle, but not so far that it is difficult to install or runs into nails from the shingles.

The gutter protector 10 further includes a middle portion 12*b*. In the embodiment illustrated in FIG. 1, the middle portion 12*b* includes two sets of openings 11*a*, through which water may fall as indicated by the arrows 13*a*. The middle portion 12*b* also includes a ridge 11*b*. This ridge slows the flow of water over the gutter protector 10, causing additional water to flow through holes 11*a*.

The gutter protector 10 also includes an arcuate bend 12*c* and a lower portion 12*d*. As indicated by arrows 13*a*, water may flow over the arcuate bend 12*c*. Surface tension causes the water to follow the bend, along the lower portion 12*d* of the gutter protector 10, and ultimately into the gutter 15. The bottom-most portion 17*a* of the gutter protector 10 rests on the bar hanger 16, as indicated at 17*b*.

The arrow 13*a* indicates how water flows through and around the gutter protector 10 into the gutter 15. Debris, such as leaves, 13*b* is generally too large to flow through the openings 11*a* and is not held by surface tension of the water to flow around arcuate bend 12*c*. Accordingly, debris 13*b* flows off of the edge of the gutter protector 10, over the lip 15*a* of the gutter 15 and to the ground.

The embodiment illustrated in FIG. 1 is significantly improved over known deflector systems. As noted above, deflector systems fail when a lot of water is flowing along the deflector, or if the water is flowing at a high speed—either high speed or heavy flow will cause water to flow over the edge of the deflector, over the lip if the gutter, and to the ground, preventing the gutter from serving its purpose.

The embodiment of a gutter protector 10 according to FIG. 1 is significantly more efficient. Here, water can flow into the gutter through the middle portion 12*b* of the gutter protector 10, through openings 11*a*. This reduces the amount of water flowing around the arcuate edge 12*c*, improving the efficiency and performance of the gutter protector system.

This embodiment is also more efficient than screen type devices. By including another mode of permitting water to enter the gutter (flowing over the arcuate bend 12*c*), the number of screen holes can be reduced or configured in such a manner as to reduce the amount of debris falling into the gutter or getting caught in the screen.

A gutter protector according to the embodiment illustrated in FIG. 1 may be installed in the following manner. The upper portion 12*a* of the gutter protector 10 is slid up under shingles 19. The lower part of the gutter protector 17*a* rests on the bar hanger 16 (or any other device used to hold the gutter up, such as a gutter spike, strap hanger or other device). To prevent the gutter protector 10 from sliding out from under the shingles 19 towards the lip 15*a* of the gutter 15, a clip 18*a* is attached to the gutter protector 10. The clip 18*a* is formed generally as an "S." The bottom of clip 18*a* tucks into the lip 15*a* of the gutter 15. The top of the clip 15*a* is then secured to the gutter protector 10. This may be done using any of a number of conventional means. For example, the clip 18*a* may be secured by pop rivet 18*b* to the gutter protector 10. In the alternative, screws could be used. In another embodiment, gutter protector 10 could include pre-drilled holes, the clips could include pre-drilled holes, and a plastic plug used to secure the clip 18*a* to the gutter protector 10. One advantage of using a clip 18*a* is that the clip is easily removed. Once removed, the gutter protector 10 is easily removed from under the shingles 19, permitting access to the interior of the gutter 15.

Figure 2:
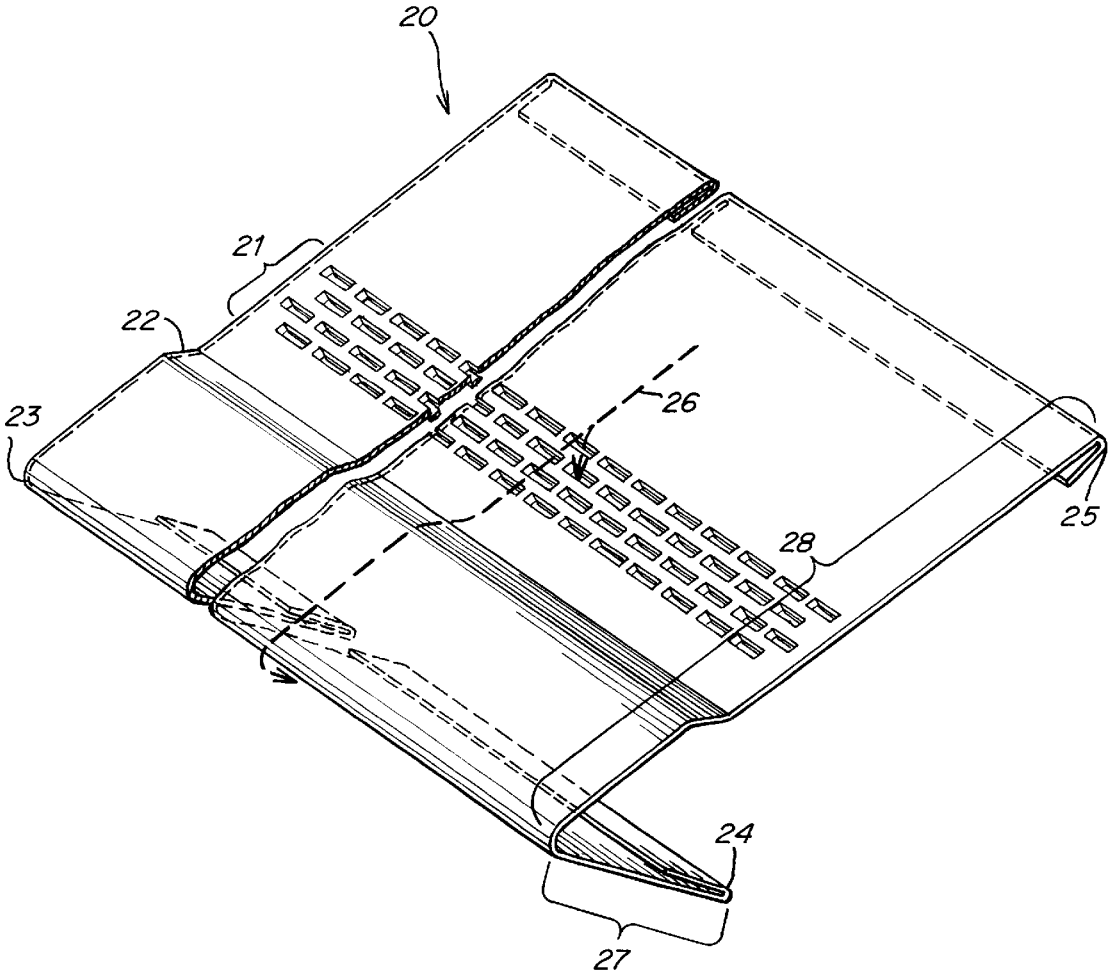
FIG. 2 illustrates a gutter device according to one embodiment of the present invention.

FIG. 2 illustrates another embodiment of the present invention. This particular embodiment is formed of 0.019" or 0.024" gauge aluminum, although other thicknesses or materials may be used. The length 28 of the gutter protector 20 is about 7½ inches. In this embodiment, a single row of openings 21 is included. A ridge 22 serves to hold water to assist it passing through the openings 21. An arcuate bend 23 is formed to prevent water to flow over the bend. The shape of the bend is generally rounded, although other configurations could be adopted. A lower portion 27 is about 1½ inches in length.

The top edge of the gutter protector 20 has a bend 25. The bend 25 is about ¾ inch in length, and makes the top edge of the gutter protector more rigid than if the bend were omitted. In addition, the bend can serve to assist in keeping the gutter protection device 10 from sliding out from under the shingles, after installation. The bend 25 in the embodiment of FIG. 2 is bent downward, although a bend in the other direction would serve the same purpose.

Similarly, a bend 24 is placed at the bottom edge of the gutter protector 20, to make the gutter protector more stiff. This bend may be about ½ inch in length.

The embodiment of FIG. 2 is made of a common stock of coiled aluminum, commonly available at job sites. The embodiment of FIG. 2 may be readily manufactured using an aluminum brake. An aluminum brake is used to place folds and bends into aluminum, as known by one of skill in the art.

The openings 21 may be formed using a standard waffle cut machine, such as the TRIM A SLITTER, with perforation attachment, available from Vanmark, Inc., of Framingham Hills, Mich. This type of machine is known in the art, although typically used for the entirely different purpose of creating ventilation holes in soffit material. The openings 21 of the embodiment of FIG. 2 are described in greater detail below. Of course, regular holes of any shape may be used, to a somewhat different effect.

Of course, other methods of manufacturing gutter protectors according to the present invention are possible. In addition, the gutter protectors according to the present invention may be made of one of a variety of different materials, such as vinyl, plastic and copper.

For easy installation, the gutter protector 20 may be formed in units having a predetermined length, such as 6 feet. This would permit manageable lengths of gutter protectors to be installed. During installation, the seams of the gutter protector units simply could be overlapped.

The openings illustrated in FIG. 1 and FIG. 2 can be formed in any of a variety of ways. In particular, screens with any of a variety of opening sizes may be used; punched holes of any shape or size may be used; and any of a variety of other openings could be used.

Figure 3A:
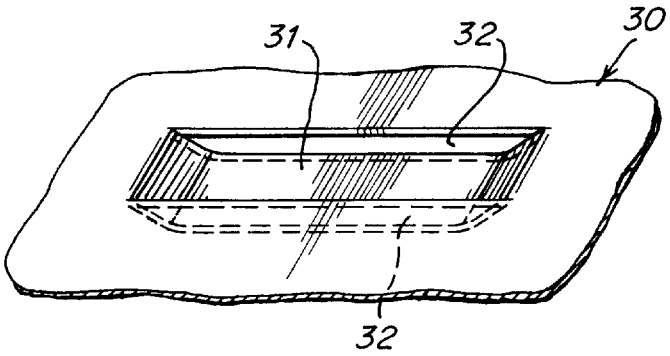
FIG. 3A illustrates a perspective view of a waffle cut opening of FIG. 1.

A particularly advantageous opening is the waffle cut opening illustrated in FIG. 3A. For this type of opening, a portion 31 of the gutter protector 30 is pushed down. The sleeves and opening 32, through which water can flow. A similar opening is present on the opposite side of the depressed portion 31, but is not illustrated because of the perspective of FIG. 3A.

Figure 3B:
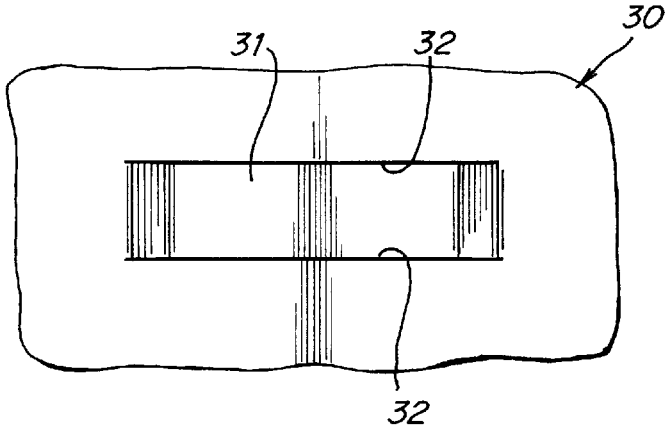
FIG. 3B is top view of FIG. 3A.

FIG. 3B is a top view of the waffle cut illustrated in FIG. 3A. Because the opening 32 is substantially vertical (i.e., a profile of the opening is substantially perpendicular to the surface 30), a top view does not permit the opening to be seen. Instead, the top view shows only the material of the gutter protector 30 and the depressed portion 31.

The waffle cut openings are also substantially improved over openings currently used. In particular, water can flow through the openings 32, but the depression 31 prevents materials from falling into the gutter or from getting stuck into the hole. Thus, the opening illustrated in FIGS. 3A and 3B reduces the amount of debris falling into the gutter which can clog the gutter and also reduces the amount of debris gathering on top of the gutter protector.

While the opening illustrated in FIGS. 3A and 3B is generally rectangular (corresponding to waffle cuts produced by currently available machines), a variety of other shapes and configurations can be used to the same effect. For example, in the embodiments of FIGS. 1 and 2, the waffle cuts are illustrated as running so that the length of the openings is transverse to the flow of water over the gutter system, indicated by arrows 13*a* and 26, respectively. This has a tendency to increase the amount of water that can flow into the gutter through the opening. In the alternative, however, the opening length can run parallel to the direction of the water. Water may still flow through the opening. By locating the opening generally parallel to the flow of water, however, the tendency of debris to get stuck in the opening can be reduced. In particular, debris is more likely to encounter an up-slope part of the depressed portion 31. The debris is, therefore, more likely to follow the up-slope, and continue on off the edge of the gutter protector.

In addition, shapes other than a rectangular depression can be used, such as circles, squares or triangles. The depression may also form only one opening (at one side of the depression), two openings (as in FIGS. 3A and 3B), or more openings. In addition, the portion 31 could be raised rather than depressed.

Figure 4:
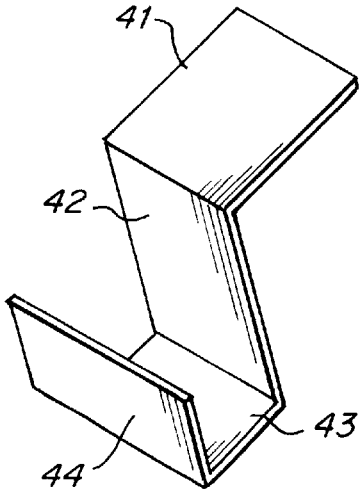
FIG. 4 illustrates a clip for use with the embodiment of FIG. 1.

FIG. 4 illustrates a clip that may be used to secure a gutter protector to a gutter. Use of this clip was described generally with reference to clip 18*a* of FIG. 1. The clip itself may be readily fashioned from aluminum or any other material. In this embodiment, a top portion 41, which is to be affixed to the gutter protector, is ½ to 1 inch in length. Bent down from this is a second segment 42 which is about 1 inch in length. Following the curve, a segment 43 is about ½ inch in length. Finally, the last bend 44 is also about ½ to 1 inch in length. While the embodiment of FIG. 1 was described as being affixed using clips such as the clip in FIG. 4, a variety of other mechanisms may be used to attach the gutter protector to the gutter.

Known gutter protection systems are currently difficult to apply to roofs of varying pitch. For example, deflector type gutter protectors are not currently available for installation on a mansard roof. A gutter protector according to the present invention, however, can be readily installed for gutters installed below such roofs.

Figure 5:
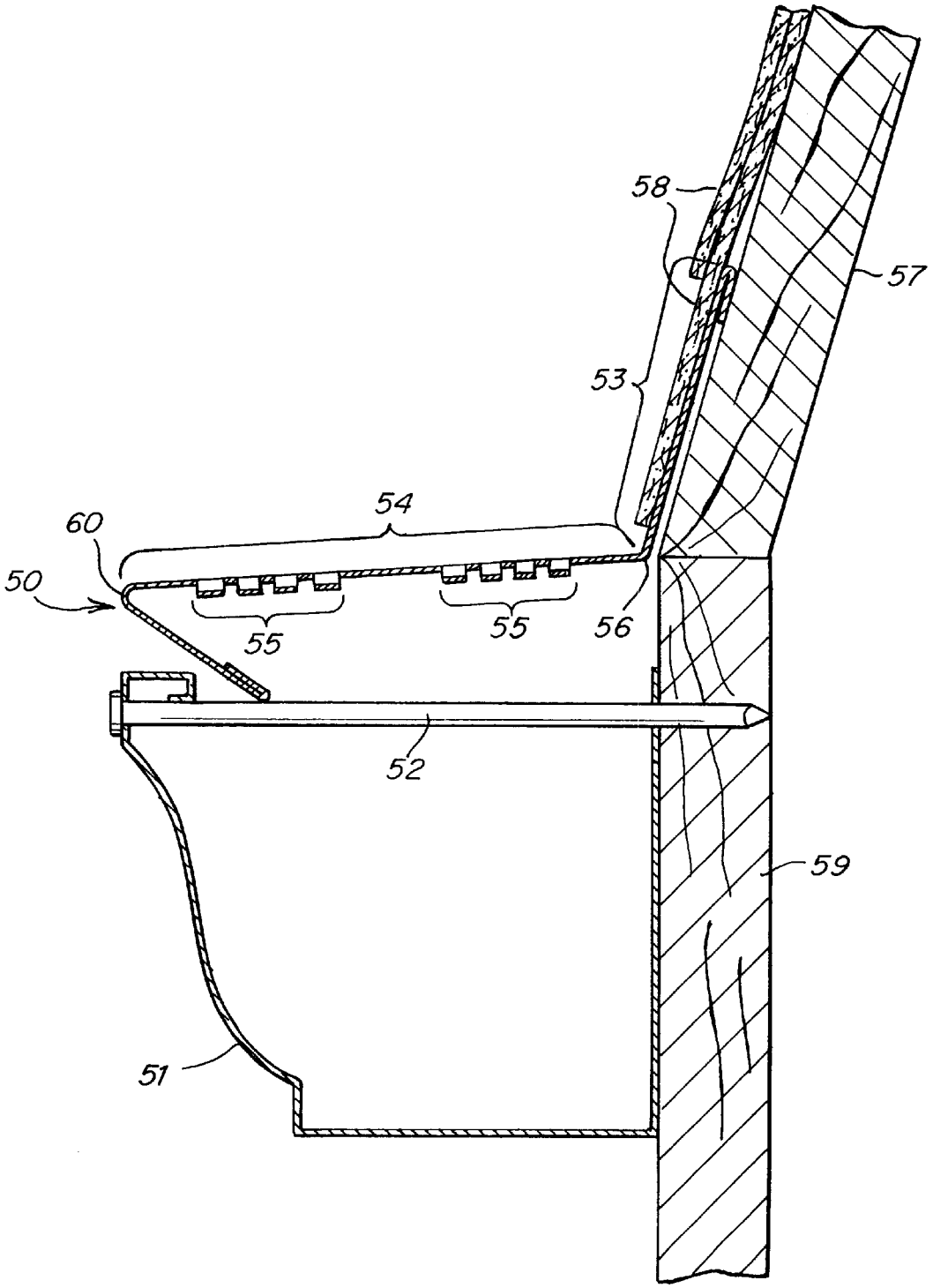
FIG. 5 illustrates another embodiment of a gutter device according to the present invention, as installed on a steep roof.

FIG. 5 illustrates one such installation. A gutter 51 is secured to the fascia board 59 using a gutter spike 52. A gutter protector 50 has an upper portion 53 installed below shingles 58 and on top of roofing board 57. Unlike the preceding embodiments, the gutter protector 50 includes a bend 56. This permits the middle portion 54 of the gutter protector 50 to be at a gentler angle than if the gutter protector 50 did not have a bend 56. Thus, when water flows down the roof off of shingles 58, the water is driven into the middle portion of the gutter protector 54. This tends to drive the water through openings 55, into the gutter. The bend also serves to substantially decrease the rate of water flow, reducing the chance that water will flow off of the arcuate end 60 and over the lip of gutter 51.

The bend 56 is made at an angle adjusted according to the pitch of the roof. Thus, a steeper roof requires a deeper bend.

As illustrated, this embodiment does not include any form of ridge located between holes 55 and the arcuate end 60. The ridge described above may be omitted from this embodiment or any other embodiment. Of course, a ridge could have been included in the embodiment illustrated in FIG. 5.

Having thus described at least one illustrative embodiment of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. A gutter protection device comprising:

an upper portion;

a substantially flat middle portion disposed adjacent to the upper portion, the middle portion including a plurality of openings; and a lower portion disposed adjacent to the middle portion, opposite the upper portion, the lower portion including a first bend;

whereby water can flow into a gutter through the plurality of openings, while debris is filtered and water can follow the first bend into the gutter while debris is filtered by the first bend, when the gutter protection device is installed on the gutter.

2. The gutter protection device of claim 1, wherein the upper portion includes a second bend.

3. The gutter protection device of claim 1, wherein the upper portion includes a second bend at an angle selected according to a pitch of a roof proximate to which the gutter protection device is to be installed.

4. The gutter protection device of claim 1, wherein the upper portion is shaped to inhibit sliding when the upper portion is disposed under shingles of a roof.

5. The gutter protection device of claim 3, wherein the upper portion, the middle portion and the lower portion are sized so that a part of the upper portion may be inserted under a lowest row of shingles of the roof.

6. The gutter protection device of claim 1, wherein the middle portion includes a raised portion positioned to increase water flowing into the openings.

7. The gutter protection device of claim 6, wherein the raised portion is a ridge bent into the middle portion.

8. The gutter protection device of claim 1, wherein the lower portion is shaped to rest on a supporting hanger for the gutter.

9. The gutter protection device of claim 1, wherein the openings are substantially vertical.

10. The gutter protection device of claim 1, wherein each of the plurality of openings is proximate a respective depressed portion of the middle portion.

11. The gutter protection device of claim 1, in combination with a clip having a first end shaped to be attached to the gutter protection device and a second end shaped to fit into a lip of the gutter.

12. The gutter protection device of claim 1, wherein the first bend is located proximate an outer lip of the gutter when the device is installed on the gutter.

13. A gutter protection device comprising:

a substantially planar surface to substantially cover a top opening of the gutter; and a plurality of openings in the surface, the profile of each opening being approximately normal to the surface.

14. A method of keeping debris from a gutter, comprising steps of:

(a) installing a gutter protection device;

(b) permitting water to enter, while keeping debris from, the gutter through a first mode of filtering; and (c) permitting water to enter, while keeping debris from, the gutter through a second mode of filtering.

15. The method of claim 14, wherein the step (b) comprises a step of passing water over a plurality of openings in the gutter protection device.

16. The method of claim 14, wherein the step (c) comprises a step of passing water over an arcuate bend in the gutter protection device, whereby water follows the bend and debris falls off of the bend.

17. The method of claim 16, wherein the step (b) comprises a step of passing water over a plurality of openings in the gutter protection device.

18. A method of preventing debris from collecting in a gutter, the method comprising steps of:

providing a gutter protection device, the gutter protection device having a surface having a plurality of openings, each opening being located proximate a respective depressed portion of the surface; and installing the gutter protection device on the gutter so that the surface is sloped toward a lip of the gutter and non-vertical.

19. The method of claim 18, wherein each depressed portion of the surface of the gutter protection device is proximate two of the openings.

20. The method of claim 18, wherein each of the openings is substantially vertical.

21. The method of claim 18, wherein the depressed portion blocks debris from entering the gutter when the device is installed on the gutter.

22. A method of preventing debris from accumulating in a gutter, the method comprising steps of:

providing a gutter protection device, the gutter protection device comprising an upper portion, including a first bend, a middle portion disposed adjacent to the upper portion, and a lower portion disposed adjacent to the middle portion, opposite the upper portion, the lower portion including a second bend, whereby water can flow over the second bend into a gutter when the gutter protection device is installed on the gutter; and positioning the upper portion under a lowest row of shingles of a roof and a lower portion proximate the lip of the gutter.

23. The method of claim 22, further comprising a step of forming the first bend at an angle selected according to a pitch of the roof.

24. The method of claim 22, further comprising steps of:

attaching a first end of a clip to the gutter protection device; and positioning a second end of the clip into a lip of the gutter.

25. The method of claim 22, wherein the positioning step comprises a step of resting the lower portion on a supporting hanger for the gutter.

26. The method of claim 22, wherein the upper portion is shaped to inhibit sliding when the upper portion is disposed under the shingles.

* * * * *